United States Patent [19]

Prins

[11] 4,058,341

[45] Nov. 15, 1977

[54] COLLAPSIBLE CHAIRS

[76] Inventor: Johannes Prins, Burg. v. Veenlaan, 411 Enschede, Netherlands

[21] Appl. No.: 675,632

[22] Filed: Apr. 9, 1976

[30] Foreign Application Priority Data

Sept. 17, 1975 Germany ..... 2541385

[51] Int. Cl.[2] ..... A47C 4/00

[52] U.S. Cl. ..... 297/39; 297/324; 297/46; 297/48

[58] Field of Search ..... 297/35, 362, 373, 46, 297/39, 378, 379, 324, 316, 366, 68, 46, 47, 48

[56] References Cited

U.S. PATENT DOCUMENTS

| | | | |
|---|---|---|---|
| 1,287,958 | 12/1918 | Giberson | 297/68 |
| 2,201,964 | 5/1940 | Blank | 297/39 |
| 2,225,306 | 12/1940 | Kovats | 297/47 |
| 2,247,799 | 7/1941 | Boardman | 297/47 |
| 2,410,088 | 10/1946 | Lundquist | 297/373 X |
| 2,939,510 | 6/1960 | Montgomery | 297/324 |
| 3,083,995 | 4/1963 | Bradshaw et al. | 297/46 X |
| 3,232,136 | 2/1966 | Bahmuller | 297/366 X |
| 3,352,580 | 11/1967 | Kurz et al. | 297/366 X |

FOREIGN PATENT DOCUMENTS

| | | | |
|---|---|---|---|
| 1,268,558 | 6/1961 | France | 297/376 |
| 713 | 1/1907 | United Kingdom | 297/47 |
| 569,590 | 1/1933 | Germany | 297/47 |

*Primary Examiner*—Roy D. Frazier
*Assistant Examiner*—Peter A. Aschenbrenner
*Attorney, Agent, or Firm*—Fitch, Even, Tabin & Luedeka

[57] ABSTRACT

A collapsible item of furniture such as a chair is disclosed as having a back-rest portion connected by a serrated means in continual meshed engagement with a serrated means connected to posterior leg portions so that the back-rest and posterior leg portions rotated concurrently with one another and relative to a seat or lying base. The serrated means are part of an articulating means comprising a pair of bowl-shaped housings encompassing the serrated means which rotate about stub shafts in the bowl-shaped housings. Anterior leg portions are connected at central locations to the front of the seat base and at upper ends to an arm rest means which, in turn, is connected to the back rest.

1 Claim, 4 Drawing Figures

COLLAPSIBLE CHAIRS

This invention relates to collapsible chairs and more particularly to an improved device for adjusting the position of the back portion relative to the seat portion of such a chair.

Collapsible chairs are known in numerous embodiments. For example, from the U.S. Pat. No. 3,037,811, a collapsible chair is known having a back support, a seating area, two leg parts and two arm rests. The back rest and the subjacent leg part are interconnected by way of the armrest. In the use of such collapsible chairs, it turned out to be desirable to design the connection between backrest and leg portion as simply as possible. The collapsing and spreading apart of the furniture items involved shall be simple and without problems. Moreover, in use, these items of furniture shall meet all safety requirements. In this respect, it is considered as disadvantageous, as far as furniture is concerned which is also used by children that when leaning back or "whipping" ("rocking") at the rear leg portion, it may hinge inwardly and cause the entire chair to collapse. In the chairs according to prior art, this collapsing indeed already is prevented by the afore described design to a certain degree; however, due to the relatively numerous articulated intermediate parts, the danger of injuries exists which have occured in practical use, particularly when such items of furniture are used by children.

The problem arises of creating a collapsible chair with a hinge which is completely safe even when used by children, which can be constructed simply and ruggedly and which assures a long lasting efficiency in use.

These problems are solved in a collapsible chair having an articulation with at least three extension parts, one of the extension parts being connected rigidly to a basis portion while the ends of two other extension parts are provided with serrated parts, serrated into each other and arranged rotatably about shaft stubs connected to the base part. The proposed member thus has two extension parts to which, for example, the back rest and the leg part can be connected which upon collapsing move toward the rigid extension part, whereby the angle tensioned between them is reduced constantly. This exclusive possibility of an opposing movement prevents back part and leg part from moving independently of each other, as this would cause the dreaded "break down" of the collapsible chair.

The articulation preferably is made from a base part comprising two bowls which hold the shaft stubs between them around which the serrated crowns are rotatable. This embodiment has the advantage that a closed articulation is present, into which one cannot put the hands, so that injuries are avoided. Yet the manufacture of this joint can be carried out at very favorable cost, as the bowls are pressed and/or injection molded from sheet metal or plastic.

To avoid furthermore lubrication of the hinged parts between the rear leg portion and the back part and the seating area, and to also avoid rusting of sluggishness, the collapsible chair may be of such a design that the articulation shows between seat and back portion at the end of the corresponding leverage part, one serrated part each whose serrations engage into each other and allow only a unidirectional movement of these parts, and that the serrated parts consist of plastic, whereby such a plastic may be polyamide or some equivalent material.

The invention moreover relates to a collapsible item of furniture, specifically a collapsible chair with back rest and two leg frames which is provided with the joint as described. Such a collapsible item of furniture has a posterior leg part, located in the area of the back support connected to the one mobile articulated extension part and a back rest connected to the other mobile articulated extension. The seating area is connected to the rigid extension part. As a result of this arrangement, the back rest and foot portion move during collapsing operations toward the seating area, whereby the angle tensioned between them is reduced. In no case is it possible that during "rocking" the postier foot portion hinges inwardly independently, thereby tipping the chair over rearwardly.

Preferably, a collapsible chair is suggested as embodiment of the invention which is characterized by an armrest with two terminal articulation points which are connected on the one hand to the back rest in its central portion so that during collapsing between armrest, extension of the anterior leg portion, seating surface and backrest, the chair forms a narrowing parallelogram and between anterior and posterior leg part, seating area and supporting surface, it will form a narrowing trapezoid.

Another problem of the invention consists of creating a collapsible occasional chair having an upholstery or cover which can be removed for washing, whose fastening can be retensioned without any problem, which has a particularly attractive modern appearance and which furthermore has a support where the loads are highest by the user and which ultimately can be produced economically and simply.

According to the invention, this problem is solved in that the cover for the seat part and the backrest is continuous, has a row of eyes each at its longitudinal parts, and forms at its narrow sides one pocket each which is placed in each case over the outer ends of the seat portion and the backrest, that a cord is strung through these eyes and looped between adjacent eyes about the lateral bars of the seat part and the backrest, and fastened in the area of the aperture of the pockets. Retensioning can be made possible by reknotting the fastening, whereby the support in the areas exposed to the highest loads is accomplished by the clasp lock.

The invention is exemplified below by way of an embodiment and with the aid of drawings, in which.

Figure 1:
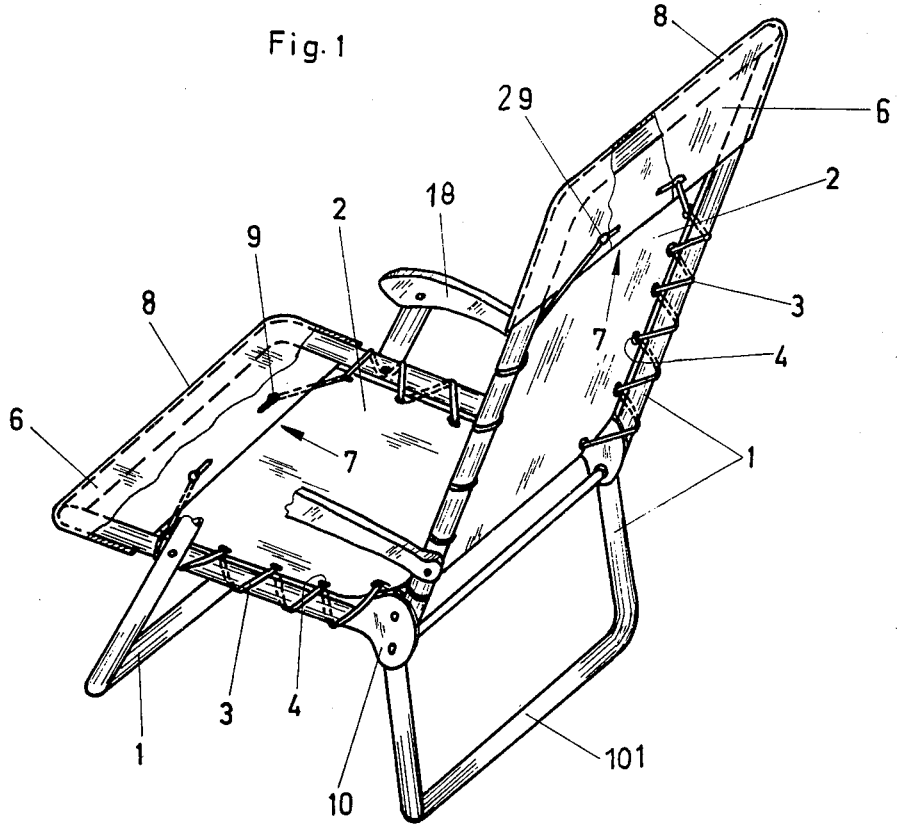
FIG. 1 shows a view in perspective of the collapsible chair with parts partly brokwn off.

According to FIG. 1, the collapsible chair comprises a collapsible frame 1 provided with a cover 2. The connection between the cover 2 and the frame 1 is accomplished via a cord or string, said cover having at its lateral edges a number of eyes 4 and the cord being looped in each case about the bars of the frame 1, and drawn with each winding once through one of the eyes.

On the top and bottom the cover 2 has one pocket 6 each which is formed by a pocket clasp 8 stitched at the sides and whereby the ends of the backrest and of the seat part can be inserted into the pocket openings 7. For a retensioning the ends of the rope can be reknotted, so that even under prolonged use the cover always can be tensioned smoothly.

As can be seen, it is possible to apply the cover by simple overplacing of the pockets and by tightening the cord, and by making the cord in a different but matching color that is, a color other than the cover, it becomes particularly attractive.

An articulation 10 is provided between backrest 29 and seat portion 28 and at the rear leg portion 101, permitting a uniform but opposing movement of the rear leg portion and the backrest, so that they can be hinged to the seat portion. One serrated part 12 and 13 each may be attached to the bar ends of the leg part and the back rest, which part is made of plastic, aluminum or galvanized steel panel. When using plastic, corrosion or sluggish movements are avoided.

The articulation 10 consists of a two-bowl base part 32 with a rigid extension part 33 fastened to it on one side. The base part — only one part is shown in the drawing — comprises two bowls which between them in the area of the recesses 34 and 35 leave slots open through which the extension parts protrude. The extension part 33 is connected to the seat part 28, and extension parts 36, 37 are connected to the backrest 29 and/or the posterior leg portion 101.

The ends of the extension parts 36, 37 are provided with inter-serrated toothed parts 12, 13. The round ends 14, 15, provided with the serrated parts, are designed as wheel-like parts and arranged rotatably about shaft stubs 16, 17.

The serrated parts 12 and 13 either can be inserted into or placed on the bar ends or be connected with them in some other manners, for example, via clamping or threads. The bowl parts 32 of the articulation 10 applied in extension of the seat portion may likewise be made of plastic or other materials, like galvanized steel panels, aluminum panels, or the like.

Figure 3A:
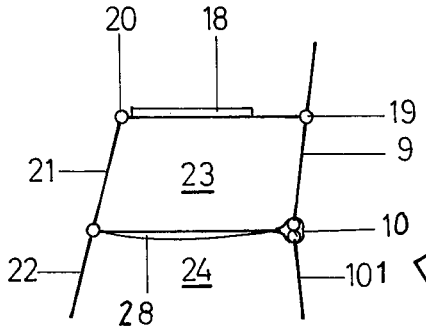
FIGS. 3*a* and 3*b* show diagrams of the collapsible chair from the side.
Figure 3B:
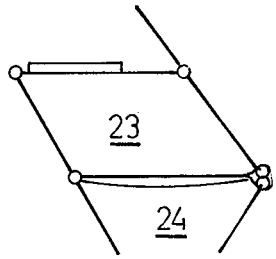
Figure 2:
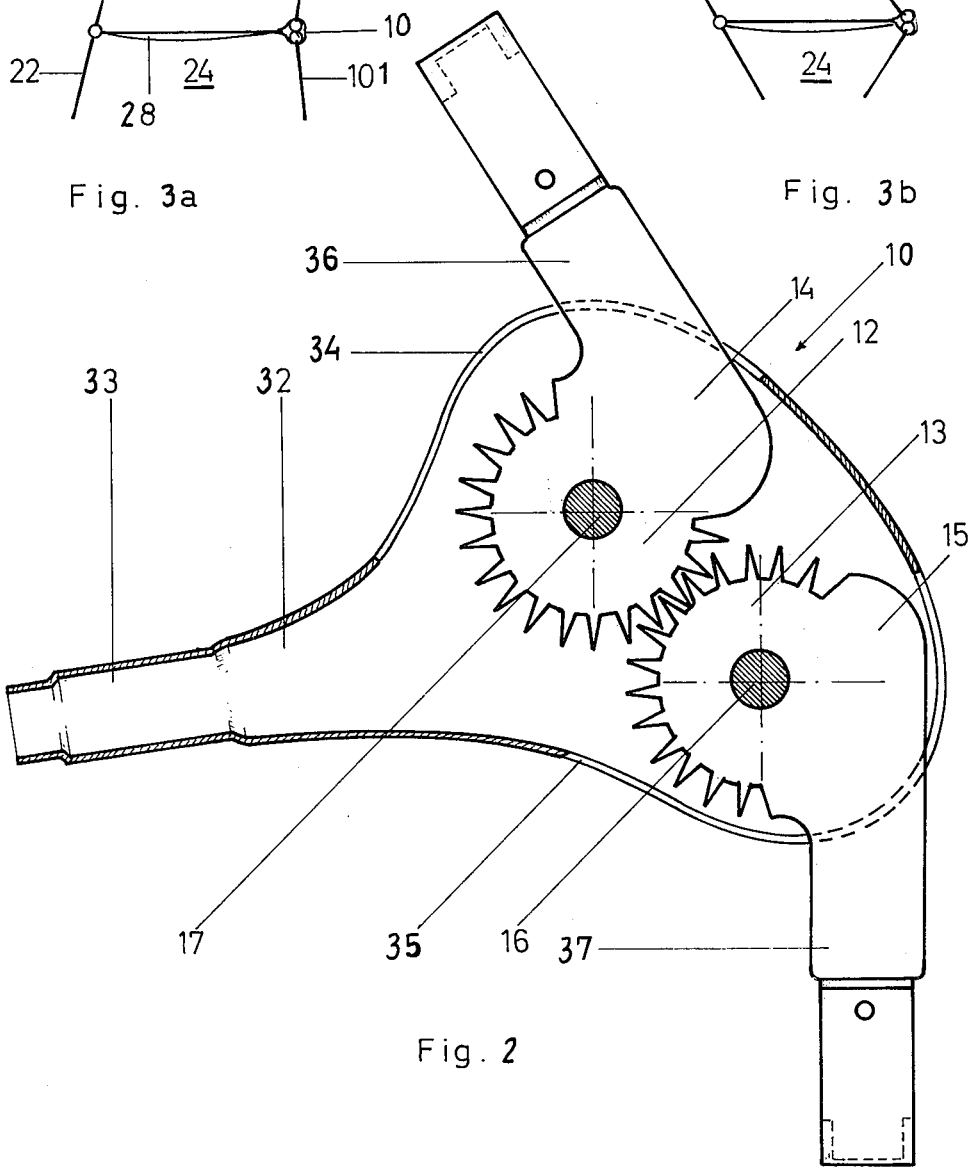
FIG. 2 is a section through the articulation between backrest and posterior leg portion on the one hand and the seat part.

The function of the serrated crowns with the connected extension parts can easily be seen in FIG. 2: if the extension part 37 is rotated clockwise or counterclockwise, this movement is transmitted with the aid of the serrated crown to the end 14 of the extension part 36 which in mirror-image movement likewise moves to the right or left. If the articulation is inserted into a collapsible chair, as shown in FIGS. 3*a* and 3*b*, it is easy to see that with the hinging of the leg part 101 inwardly, the backrest likewise pivots inwardly in the direction of the seat part 28. This snychronous movement prevents the leg part 101 from moving inwardly in an independent manner. In a normal case, the person seated on the collapsible chair presses with his back against the backrest 29, and thus prevents part 101 from hinging inwardly.

One collapsible chair proved to be a particularly advantageous embodiment where in addition to the mentioned connections of the backrest and the leg part of the articulation 10, an arm rest 18 is provided with two terminal articulated points 19 and 20 which are connected on the one hand with an extension 21 of the anterior leg portion 22 and on the other hand with the backrest 29 in its central area so that upon collapsing or folding the chair tensions on between armrest, extension of the anterior leg portion, the seating surface and the backrest a narrowing parallelogram and between the anterior and posterior leg portion, the seating area and the supporting surface, a narrowing trapezoid.

It has been found in practice that the articulation 10 also is appropriate for collapsible chairs with foot supports for lawn chairs with backrests and for other furniture where a unidirectional movement of two members shall exist.

Deviations from the proposed embodiment are of course possible, without going beyond the scope of the invention by doing so.

Reference also shall be made to the particularly advantageous possibility whereby at least one of the shaft stubs is to be extended out of the bowl of the basic part, so that it may serve, for example, as an articulated extension for the frame construction of the seating surface.

What is claimed is:

1. A collapsible item of furniture for lying or sitting thereon comprising a back rest, a seat or lying base 28, a front leg pivoted centrally to the seat, an arm rest pivotally connected at one end to the upper end of the front leg, said arm rest being pivotally connected to its other end to said back rest, said front leg collapsible toward the rear leg when said chair is folded, leg means including two posterior leg portions, an articulation means connecting said back rest and said base and said posterior leg portions.

said articulation means comprising a first extension portion connected to said base, a second extension portion connected to said back rest, a third extension portion connected to said posterior leg portion, a first serrated means on said second extension portion turnable about an axis to pivot said back rest, a second serrated means on said third extension portion in continual meshed engagement with said first serrated means and rotatable about an axis to pivot said posterior leg portions, said first and second serrated means being in continual meshed engagement for simultaneously and concurrently driving and turning engagement with each other and to concurrently pivot said back rest and said posterior leg portions simultaneously, said articulation means comprising two bowl-shaped base members for encapsulating said first and second serrated means, said first extension comprising rigid extensions formed on said bowl-shaped base members, stub shafts carried by said bowl-shaped base members and defining the respective axes for said first and second serrated means, and said bowl-shaped base members having recesses therein defining slots through which project said second and third extension.

* * * * *